US009872517B2

(12) United States Patent
Reed et al.

(10) Patent No.: US 9,872,517 B2
(45) Date of Patent: Jan. 23, 2018

(54) TOBACCO SMOKE FILTER

(71) Applicant: ESSENTRA FILTER PRODUCTS DEVELOPMENT CO. PTE. LTD, Novena Square (SG)

(72) Inventors: James D. Reed, Newcastle (GB); Bennett C. Ward, Richmond, VA (US)

(73) Assignee: ESSENTRA FILTER PRODUCTS DEVELOPMENT CO. PTE. LTD., Singapore (SG)

( * ) Notice: Subject to any disclaimer, the term of this patent is extended or adjusted under 35 U.S.C. 154(b) by 163 days.

(21) Appl. No.: 14/438,019

(22) PCT Filed: Oct. 22, 2013

(86) PCT No.: PCT/EP2013/072039

§ 371 (c)(1),
(2) Date: Apr. 23, 2015

(87) PCT Pub. No.: WO2014/064087

PCT Pub. Date: May 1, 2014

(65) Prior Publication Data

US 2015/0272207 A1 Oct. 1, 2015

Related U.S. Application Data

(60) Provisional application No. 61/717,883, filed on Oct. 24, 2012.

(30) Foreign Application Priority Data

Nov. 7, 2012 (GB) ..... 1220098.6

(51) Int. Cl.

| | |
|---|---|
| ***A24D 3/06*** | (2006.01) |
| ***A24D 1/02*** | (2006.01) |
| ***A24D 3/02*** | (2006.01) |

(52) U.S. Cl.

CPC ..... *A24D 3/065* (2013.01); *A24D 1/025* (2013.01); *A24D 3/0291* (2013.01); *A24D 3/063* (2013.01); *A24D 3/067* (2013.01)

(58) Field of Classification Search

None

See application file for complete search history.

(56) References Cited

U.S. PATENT DOCUMENTS

| | | | |
|---|---|---|---|
| 3,428,050 | A | 2/1969 | Kandel |
| 3,768,489 | A | 10/1973 | Kiefer et al. |

(Continued)

FOREIGN PATENT DOCUMENTS

| | | | |
|---|---|---|---|
| CN | 2415620 | Y | 1/2001 |
| CN | 201657768 | U | 12/2010 |

(Continued)

OTHER PUBLICATIONS

UKIPO Search Report issued in Application No. GB1220098.6 dated Mar. 8, 2013 (4 pages).

(Continued)

*Primary Examiner* — Michael H Wilson
*Assistant Examiner* — Katherine Will
(74) *Attorney, Agent, or Firm* — Flynn, Thiel, Boutell & Tanis, P.C.

(57) ABSTRACT

A tip for a smoking article such as a cigar is disclosed. The tip comprises a longitudinally extending element comprising a plurality of bicomponent fibers which define at least one channel extending longitudinally of the element.

20 Claims, 1 Drawing Sheet

(56) References Cited

U.S. PATENT DOCUMENTS

| | | | | |
|---|---|---|---|---|
| 4,423,744 | A | 1/1984 | Berger | |
| 5,509,429 | A * | 4/1996 | Brackmann | A24D 3/04 131/339 |
| 5,509,430 | A | 4/1996 | Berger | |
| 5,607,766 | A | 3/1997 | Berger | |
| 6,103,181 | A | 8/2000 | Berger | |
| 6,718,987 | B1 | 4/2004 | Pogossian et al. | |
| 2005/0066981 | A1 | 3/2005 | Crooks et al. | |
| 2012/0305010 | A1 | 12/2012 | Mishra et al. | |
| 2013/0025610 | A1* | 1/2013 | Sebastian | A24D 3/068 131/332 |

FOREIGN PATENT DOCUMENTS

| | | | |
|---|---|---|---|
| EP | 1 163 857 | A1 | 12/2001 |
| WO | WO 95/16369 | A1 | 6/1995 |
| WO | WO 2012/012053 | A1 | 1/2012 |
| WO | WO 2012/129038 | A1 | 9/2012 |

OTHER PUBLICATIONS

Form PCT/ISA/210 issued in PCT/EP2013/072039 with a mailing date of Jan. 20, 2014 (3 pages).
Form PCT/ISA/220 issued in PCT/EP2013/072039 with a mailing date of Jan. 20, 2014 (1 page).
Form PCT/ISA/237 issued in PCT/EP2013/072039 with a mailing date of Jan. 20, 2014 (4 pages).

* cited by examiner

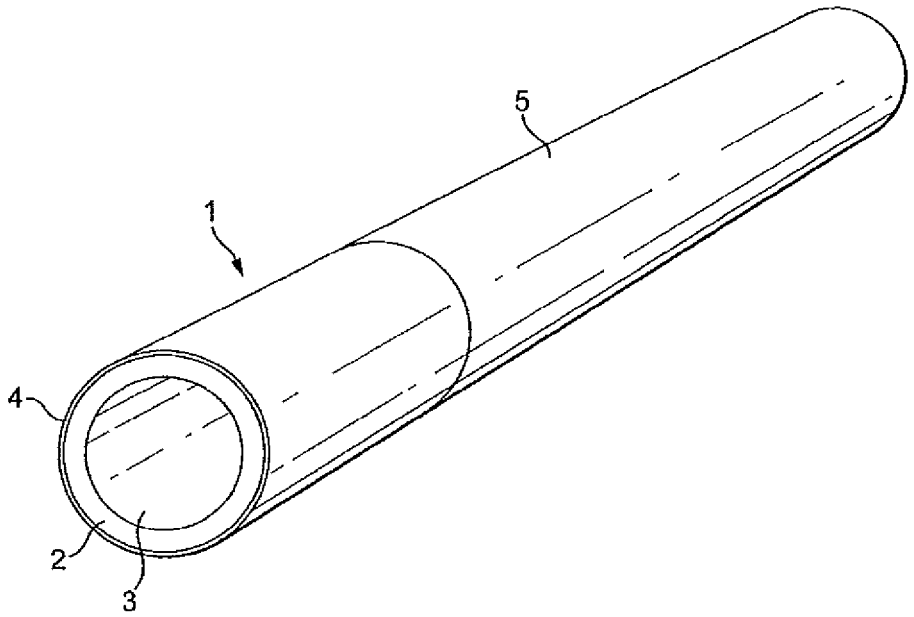
5
1
4
2
3

TOBACCO SMOKE FILTER

CROSS REFERENCE TO RELATED APPLICATIONS

This application is the National Stage of International Application No. PCT/EP2013/072039, filed Oct. 22, 2013, which claims the priority of Great Britain Application No. 1220098.6, filed Nov. 7, 2012 and U.S. Provisional Application No. 61/717,883, filed Oct. 24, 2012.

FIELD OF THE INVENTION

The present invention relates to tips such as mouthpieces for smoking articles such as cigars and cigarillos.

BACKGROUND OF THE INVENTION

Cigars or cigarillos are frequently sold attached to a plastic or 'wood' tip and numerous cigar brands of this type of construction are known. Such tips normally comprise a circular tubular section at one end (into which the end of the cigar is inserted) and a tapered, or fluted, section at the other end that the smoker places between their lips. These tips are normally hollow and do not exert any filtering effect on the smoke, although variants in which a filtering medium can be included within the tip are known. The purpose of the tip is to enable the smoker to smoke the product along most of its length (e.g. which he would be unable to do with a simple unfiltered cigar) and to provide a cooling sensation to the smoke. Disadvantages with these plastic or 'wood' tips are that they are relatively costly to manufacture (normally by an injection moulding process), they are difficult to connect to the cigar column using high speed machinery (e.g. as they all need to be orientated in the same direction due to their non-symmetrical nature) and they give a cold and unyielding 'mouthfeel' when placed between the smokers lips.

Filtered cigars are also commercially available and these are analogous to filtered cigarettes in that a plug (normally of cellulose acetate) is connected to the wrapped cigar column, typically by use of a tipping overwrap. However, these tend not to be popular with cigar smokers as the filter affects the sensory characteristics of the smoke and cigar smokers generally prefer the taste associated with unfiltered smoke. In addition, it is possible that plasticizers applied to the filter material (e.g. glycerol triacetate in the case of cellulose acetate) may be transferred to the smoke, further influencing the sensory properties. In addition, the appearance of the filtered cigar or cigarillo can be unappealing to some smokers as there can be a marked contrast between the brown cigar wrapper and the white filter material occupying the entire cross-section of the mouth end.

The technology to make shaped and tapered filters using modified cigarette filter making machinery is also known (e.g. see U.S. Pat. No. 4,423,744). Whilst these can be produced at high speed as a continuous rod and could potentially be used to provide tips for narrower diameter cigars or cigarillos, the section where the continuous rod is cut into finite lengths can have sharper edges that are undesirable to the smoker.

It is desirable to provide a tip (e.g. mouthpiece) which overcomes these advantages.

SUMMARY OF THE INVENTION

According to the present invention there is provided a tip for a smoking article, the tip comprising a longitudinally extending (e.g. tubular) element comprising a plurality of bicomponent fibres which define at least one (e.g. hollow) channel extending longitudinally of (e.g. through) the element.

The longitudinally extending element comprising a plurality of bicomponent fibres may be cylindrical. The longitudinally extending element comprising a plurality of bicomponent fibres may be of annular cross section (e.g. so the bicomponent fibres which form the inner walls of the annulus define a single hollow channel of circular cross section extending longitudinally of (e.g. through) the element). The longitudinally extending element may comprise a plurality of bicomponent fibres which define two or more channels extending longitudinally of (e.g. through) the element.

Preferably, the (or each) channel extends along (e.g. through) the full length of the element.

The bicomponent fibres which form the longitudinally extending element are not as cold or rigid as those of 'wood' tips and consequently provide a more pleasant lip contact sensation for the smoker (e.g. more akin to that of a cigarette). Thus, the tip of the invention provides a pleasant 'mouthfeel' for the smoker, does not affect the sensory characteristics of the smoke (e.g. which travels along the hollow tube), and has a pleasing and distinctive end appearance.

Preferably the longitudinally extending element is of uniform cross section.

A cigar or cigarillo is normally differentiated from a cigarette in that the tobacco column of a cigar or cigarillo is wrapped in tobacco leaf or similar material, whilst the tobacco column of a cigarette is wrapped in thin paper. It will be appreciated that any reference to 'cigar' made herein applies equally to 'cigarillo'. With the tip of the invention, the external dimensions (e.g. diameter) of the longitudinally extending element may be selected so they are similar to that of the cigar or cigarillo tobacco column, so the tip can be directly connected to the cigar by use of a tipping paper using machinery based on that used for assembling cigarettes. Further, the tips may be symmetrical, so there is no need for them to be oriented during production as is the case for 'wood' tip cigars. This enables greater speeds and efficiencies in assembling the product as compared to 'wood' tip cigars. Thus, cigars and cigarillos including the tip of the invention are highly cost-effective to manufacture, because the tip can be connected to the tobacco column using conventional high-speed machinery. A further advantage is that, because the resultant tipped cigar may be uniform over its entire length (i.e. there is no lip as can be created when a wood tip is connected to a cigar column), it is easier to pack a group of tipped cigars according to the invention into a standard rectangular shaped cigar pack.

The longitudinally extending element may comprise a plurality of bicomponent fibres at a bonded fibre density of 0.20 to 0.44 g/cc, preferably 0.25 to 0.35 g/cm, preferably 0.29 to 0.31 g/cc. This (bonded) fibre density ensures that the wall does not create any filtering effect (and therefore does not affect the taste) and provides sufficient hardness to the final tip.

The longitudinally extending element may have a hardness of ≥96%, for example 97 to 99.5%, e.g. around 99% [as measured on a Filtrona Hardness Tester (Manual) Model DHT200 (Vidus Instrument Co., Richmond, Va.)]. This is distinctly harder than conventional cigarette filter tips (which usually have maximum 95% hardness, as measured on a Filtrona Hardness Tester (Manual) Model DHT200).

The bicomponent fibres are preferably white in colour. The bicomponent fibres may include pigment (e.g. if it is desired to have a coloured tip, e.g. to denote different brand variants, e.g. as an anti-counterfeiting measure).

Bicomponent fibres are well known, from e.g. U.S. Pat. No. 5,607,766. Herein, the term "bicomponent fibre" means a fibre comprising two components which has a cross section, extending along the length of the fibre, wherein the two components are separated into relatively distinct component regions. The term bicomponent fibre includes fibres which include a core of one material (first component) surrounded by a sheath of another material (second component). Such a sheath-core arrangement may include a configuration wherein a monocomponent fibre (such as cellulose acetate) is coated with another component (e.g. a plasticiser). The term bicomponent fibre includes other arrangements such as those wherein the cross section extending along the length of the fibre includes the two components arranged side-by-side or layer-by-layer; those wherein the cross section extending along the length of the fibre includes the first components disposed as discrete areas (islands) within the second component; and those wherein the cross section extending along the length of the fibre includes the components arranged as alternating wedge shaped segments (e.g. looking like a pie with alternating slices of different components). It is preferred that the bicomponent fibres include a core of one material (first component) surrounded by a sheath of another material (second component).

The longitudinally extending element may be formed by a melt blowing process, for example similar to processes described in U.S. Pat. No. 5,607,766 or U.S. Pat. No. 6,103,181. U.S. Pat. No. 5,607,766 describes the manufacture and use of bicomponent melt blown fibres, typically comprising a core of polypropylene or polybutylene terephthalate surrounded by a sheath of polyethylene terephthalate. U.S. Pat. No. 6,103,181 describes the manufacture and use of bimodal melt blown fibres, comprising fibres of differing characteristics extruded from the same die (e.g. different monocomponent fibres, different bicomponent fibres or mixtures thereof). These documents describe the use of such melt blowing processes to lay down a web or roving of fibre that is subsequently formed into a three dimensional network using a thermoforming technique. It is well-known that such thermoforming techniques can be adapted to produce a three dimensional tubular structure. A further advantage of using the aforementioned melt blown technology in the present invention is that there are no binders or plasticizers present that could potentially transfer from the tube walls into the smoke. U.S. Pat. No. 5,607,766 also refers to the production of tobacco smoke filters from such bicomponent melt-blown fibres. However, a cigarette filter made using such fibres has a less desirable taste than that associated with a conventional cellulose acetate filtered cigarette. The present invention overcomes this limitation as the bicomponent fibres do not play any role in filtering the smoke (i.e. the smoke simply passes along the channel(s) without interacting with the fibres).

It will be appreciated that it is also possible to make longitudinally extending elements for use in aspects of the invention using technologies other than those based on bicomponent melt-blowing. For example, the longitudinally extending element may comprise cellulose acetate (or other monocomponent fibre) plasticised with triacetin (or other plasticiser) to form a coated (bicomponent) fibre, as is well-known in the art. It is also possible to use other forms of nonwoven technologies (rather than melt-blowing) to produce a web or roving of bicomponent fibres, which can subsequently be formed into the desired bonded three dimensional longitudinally extending element.

The tip may further comprise a wrapper (e.g. of plugwrap paper) engaged around the longitudinally extending element. The wrapper, for example plugwrap paper, may be printed or coated (e.g. on its radially outer surface), e.g. with a pattern, e.g. a tobacco leaf effect, on its outer surface. This may overcome the less aesthetically pleasing appearance associated with a plugwrap paper. Preferably the wrapper is hydrophobic, e.g. on its radially outer surface, e.g. has a hydrophobic coating. The hydrophobic wrapper may prevent (or reduce incidence of) the smokers' lips from sticking to the filter (tip).

The tip may be of length 5 to 40 mm, e.g. 15 to 35 mm, e.g. 20 to 30 mm. The longitudinally extending element may be of length 10 to 40 mm, e.g. 15 to 35 mm e.g. 20 to 30 mm, e.g. 17 to 25 mm.

The tip may have an external diameter of 4 to 21 mm. The tip may have an external diameter of 5 to 21 mm (i.e. suitable for all sizes of cigars and cigarillos). The diameter of the (or each) longitudinally extending channel (e.g. hollow tube) may be 0.5 to 10 mm, for example 1 to 6 mm, for example 2 to 5 mm. Preferably, the cross-sectional area of the longitudinally extending channel(s) is 2.5 to 25% of the cross sectional area of the longitudinally extending element. If there is a single channel, the diameter of the longitudinally extending channel may be 5 to 50% of that the external diameter of the tip (equivalent to 2.5 to 25% of the cross-sectional area of the longitudinally extending element). If two or more longitudinally extending channels are present, these will preferably be of the same cross-section. If two or more longitudinally extending channels are present, their combined cross-sectional area is preferably 2.5-25% of the cross-sectional area of the tip.

The or each (e.g. hollow) channel extending longitudinally of (e.g. through) the element may have any cross-section. Preferably the cross section is symmetrical. A circular cross-section is preferred.

It is possible for there to be a filter element upstream of the longitudinally extending element. According to the present invention, there is provided a tobacco smoke filter or filter element comprising: an upstream filter element including a tobacco smoke filtering material; and a downstream (buccal end) tip comprising a tip according to the invention as set out above. The upstream filter element may further comprise a frangible capsule or frangible capsules, or one or a plurality of frangible microcapsules. The capsule(s) or microcapsule(s) may contain a variety of media—e.g. a flavourant (e.g. menthol) and/or a liquid, solid or other material e.g. to aid smoke filtration e.g. activated carbon The use of capsules or microcapsules, and their inclusion in filters/filter elements, is well known in the art.

Thus, according to the present invention in a further aspect there is provided a tobacco smoke filter or filter element comprising: an upstream filter element including (e.g. a longitudinally extending core of) a tobacco smoke filtering material; and a downstream (e.g. buccal end) tip comprising a longitudinally extending (e.g. tubular) element comprising a plurality of bicomponent fibres which define at least one (e.g. hollow) channel extending longitudinally of (e.g. through) the element. The filter or filter element may further comprise a wrapper (e.g. of plugwrap paper) engaged around the upstream filter element and downstream tip. The wrapper, for example plugwrap paper, may be printed or coated (e.g. on its radially outer surface), e.g. with a pattern, e.g. a tobacco leaf effect, on its outer surface. This may overcome the less aesthetically pleasing appearance associated with a plugwrap paper. Preferably the wrapper is hydrophobic, e.g. on its radially outer surface, e.g. has a hydrophobic coating. The hydrophobic wrapper may prevent (or reduce incidence of) the smokers' lips from sticking to the filter (tip). The tip may be any tip according to the invention.

The filtering material may be for example any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. It may be, for example, natural or synthetic staple fibres, cotton wool, web material such as paper (usually creped) and synthetic non-wovens, and extruded material (e.g. starch, synthetic foams). The filtering material may be a cellulose acetate tow. The upstream filter element may further comprise a frangible capsule or frangible capsules, or one or a plurality of frangible microcapsules. The capsule(s) or microcapsule(s) may contain a variety of media—e.g. a flavourant (e.g. menthol) and/or a liquid, solid or other material e.g. to aid smoke filtration e.g. activated carbon The use of capsules or microcapsules, and their inclusion in filters/filter elements, is well known in the art. The upstream filtering element may include an adsorbent material (e.g. activated carbon). The upstream filter element may include a flavour material (e.g. menthol). It will be appreciated that inclusion of a filtering element is not a preferred construction, because the filtering element may impact the sensory characteristics of the cigar or cigarillo.

In an example, the wrapper may extend beyond the end of the upstream element around which it is engaged, to define a (e.g. tubular) cavity at the upstream end of the filter or filter element. Thus, the filter/filter element may be (used as) a stand-alone filter/filter element for use with a non-filtered cigar or cigarillo (as described below for a stand-alone tip).

According to the present invention in another aspect there is provided a (stand alone) tip for a smoking article, the tip comprising a wrapper engaged around a longitudinally extending (e.g. tubular) element comprising a plurality of bicomponent fibres which define at least one (e.g. hollow) channel extending longitudinally of (e.g. through) the element; wherein at least one end of the wrapper extends beyond the end of the element around which it is engaged, to define a (e.g. tubular) cavity at the end of the tip. Preferably, the (or each) channel extends along (e.g. through) the full length of the element.

The other end of the wrapper may be flush or substantially flush with the other end of the core (e.g. so the filter or filter element has a cavity at one end—i.e. the upstream end—i.e. the end which faces and engages (connects with) the smoking article in use).

The wrapper may be paper, e.g. plugwrap paper, e.g. stiff plugwrap paper. The outer wrapper may be porous or non porous. The outer wrapper may be a paper of basis weight from about 30 to about 120 g/m$^2$. The wrapper, for example plugwrap paper, may be printed or coated (e.g. on its radially outer surface), e.g. with a pattern, e.g. a tobacco leaf effect, on its outer surface. This may overcome the less aesthetically pleasing appearance associated with a plugwrap paper. Preferably the wrapper is hydrophobic, e.g. on its radially outer surface, e.g. has a hydrophobic coating. The hydrophobic wrapper may prevent (or reduce incidence of) the smokers' lips from sticking to the filter (tip).

The radially inner face of the wrapper which extends beyond the end of the element around which it is engaged may define (e.g. with the end of the longitudinally extending element) a cavity or recess, usually a tubular cavity/recess, at that end of the tip. The recess (cavity) section of the tip (that is, the length by which the or each end of the wrapper extends beyond the end of the element around which is engaged to define the cavity at the end of the tip) may have a length 3 to 14 mm, and is most preferably of length 5 to 12 mm, for example 5, 6, 7, 8, 9, 10, 11 or 12 mm. Thus, the recess (cavity) section of the tip (that is, the length by which the or each end of the wrapper extends beyond the end of the element around which is engaged to define the cavity at the end of the tip) may be of length sufficient to provide a good interference fit between the radially inner face of the wrapper which defines the cavity, and the outer face of the smoking article (without the inserted end of the article interfering with the end of the core to prevent the fit). It will be appreciated that longer cavity lengths (e.g. 8 to 14 mm) may be required to suitably engage with wider diameter cigars. Thus, the tip may be used as a stand-alone tip element for use with a smoking article such as a non-filtered cigar or cigarillo. In this way the user is able to enjoy the advantages provided by the tip construction even if their preferred cigar brand is not commercially available with such a tip.

Herein the term "stand-alone" or "stand alone" means a single discrete filter or filter element which is not connected to a smoking article, but is made and sold for use with hand-rolled or otherwise prepared smoking articles.

The stand-alone tip may be of length 10 to 40 mm, e.g. 15 to 35 mm, e.g. 20 to 30 mm. The longitudinally extending element may be of length 10 to 37 mm, e.g. 15 to 35 mm e.g. 20 to 30 mm, e.g. 17 to 25 mm. The tip may be of diameter 4 to 21 mm. The tip may be of diameter 5 to 21 mm. The longitudinally extending channel(s) may be dimensioned as for regular (i.e. non stand-alone) tips, as described above.

As set out above, the (stand-alone) tip may be used as a stand-alone tip element for use with a smoking article such as a non-filtered cigar or cigarillo. The applicants have also found that the stand-alone tip according to aspects of the invention, or tips according to any aspect of the invention, may be used as a mouthpiece for smoking articles such as bidis and kreteks. Bidis and kreteks are smoking articles (predominantly hand-rolled) associated with the Indian and Indonesian markets respectively. The use of a tip according to aspects of the present invention with a bidi or kretek enables the smoker to enjoy the unfiltered smoke (because of the channel(s)), whilst simultaneously having the tactile advantages of a fibrous mouthpiece and being able to consume more of their original product (because the smoker can smoke substantially down to the tip).

In a smoking article (e.g. a cigar or cigarillo) according to the invention, a tip of the invention (or a filter of the invention, or a filter including a filter element of the invention) is joined longitudinally in end to end relationship with a wrapped tobacco rod with one end of the tip/filter (the upstream end) towards the tobacco. The tip or filter may be joined to the wrapped tobacco rod by ring tipping [which engages around just the adjacent ends of the (wrapped) tip/filter and wrapped tobacco rod to leave much of the filter wrap exposed]. The tip or filter may be joined by a full tipping overwrap (which engages around the full tip/filter length and the adjacent end of the wrapped tobacco rod).

BRIEF DESCRIPTION OF THE DRAWING

The present invention will now be illustrated with reference to the following Examples and the attached drawing in which FIG. 1 schematically illustrates (not to scale) a tip according to an example of the invention.

DETAILED DESCRIPTION

FIG. 1 shows a tip for a smoking article, according to an example of the invention. The tip (1) comprises a longitudinally extending element (2) of length 30 mm which is an annulus of outer diameter 10 mm, and which is formed from a plurality of bicomponent fibres. The bicomponent fibres which form the inner walls of the annular longitudinally extending element (2) define a single hollow cylindrical channel (3) of circular cross section which extends longitudinally through the element. The single hollow cylindrical channel (3) has a circular cross section of diameter 3 mm (not shown to scale). A wrapper (4) of plugwrap paper is engaged around the longitudinally extending element (2).

The annular element (1) is formed using the process described in U.S. Pat. No. 5,607,766. A nonwoven web comprising melt blown bicomponent fibres having a polypropylene core surrounded by a sheath of polyethylene terephthalate was made. This web was formed into an annular rod using apparatus similar to that known for the manufacture of plasticized cellulose acetate cigarette filter elements. The annular rod was then wrapped in a non-porous plugwrap paper, again as outlined in U.S. Pat. No. 5,607,766. The annular rod so produced was cut into discrete product rods, in this case of length 120 mm, which were then each cut into four individual tips (1) of 30 mm length.

The mean weight of each 120 mm product rod was 2.6 g. This gave a bonded fibre density in the longitudinally extending element (2) of 0.30 g/cc, which is around double the density of conventional porous cigarette filters. This higher density ensures that the longitudinally extending element (2) does have any filtering effect and provides sufficient hardness to the final tip (1). The hardness of the tip was around 99% [as measured on a Filtrona Hardness Tester (Manual) Model DHT200 (Fidus Instrument Co., Richmond, Va.)]; distinctly harder than conventional cigarette filter tips (e.g. maximum 95% hardness).

As can be seen in FIG. 1, the tip (1) is connected to a wrapped tobacco column (5) of a cigar having the same diameter as tip (1), to provide a smoking article (cigar) of the invention. The tip (1) is joined to the wrapped tobacco rod by ring tipping [which engages around just the adjacent ends of the wrapped tip and rod to leave much of the filter wrap exposed (ring tipping not shown), as is well known in the art.

The invention claimed is:

1. A tip for a smoking article, the tip comprising a longitudinally extending element comprising a plurality of bicomponent fibres which define at least one channel extending longitudinally of the element, wherein each of the at least one channel extends along the full length of the element, wherein the plurality of bicomponent fibres have a bonded fibre density of 0.20 to 0.44 g/cc, and wherein the longitudinally extending element is smoke impermeable.

2. A tip according to claim 1 wherein the longitudinally extending element is cylindrical and/or wherein the longitudinally extending element is of annular cross section.

3. A tip according to claim 1 wherein the plurality of bicomponent fibres define two or more channels extending longitudinally of the element.

4. A tip according to claim 1 wherein the longitudinally extending element is of uniform cross section.

5. A tip according to claim 1 wherein the longitudinally extending element has a hardness of 96%.

6. A tip according to claim 1 wherein the bicomponent fibres include a core of a first component surrounded by a sheath of a second component.

7. A tip according to claim 1 which further comprises a wrapper engaged around the longitudinally extending element.

8. A tip according to claim 1 wherein the cross-sectional area of each of the at least one channel is 2.5 to 25% of the cross-sectional area of the longitudinally extending element.

9. A tip according to claim 1 wherein each of the at least one channel is of circular cross section.

10. A tip for a smoking article, the tip comprising a wrapper engaged around a longitudinally extending element comprising a plurality of bicomponent fibres which define at least one channel extending longitudinally of the element; wherein at least one end of the wrapper extends beyond the end of the element around which the wrapper is engaged, to define a cavity at the end of the tip, wherein each of the at least one channel extends along a full length of the element, and wherein the plurality of bicomponent fibres have a bonded fibre density of 0.20 to 0.44 g/cc, and wherein the longitudinally extending element is smoke impermeable.

11. A tobacco smoke filter or filter element comprising: an upstream filter element including a tobacco smoke filtering material; and a downstream tip comprising a tip according to claim 1.

12. A tobacco smoke filter or filter element comprising: an upstream filter element including a tobacco smoke filtering material; and a downstream tip comprising a longitudinally extending element comprising a plurality of bicomponent fibres which define at least one channel extending longitudinally of the element, wherein each of the at least one channel extends along the full length of the longitudinally extending element of the downstream tip, and wherein the plurality of bicomponent fibres have a bonded fibre density of 0.20 to 0.44 g/cc.

13. A tobacco smoke filter or filter element according to claim 12, wherein the upstream element further comprises a frangible capsule or frangible microcapsules.

14. A tobacco smoke filter or filter element according to claim 12, which further comprises a wrapper engaged around the upstream filter element and downstream tip.

15. A tobacco smoke filter or filter element according to claim 14 comprising a further wrapper which extends beyond the end of the upstream filter element around which the wrapper is engaged, to define a cavity at the upstream end of the filter or filter element.

16. A tip according to claim 10, wherein the wrapper is printed or coated on an outer surface thereof; and/or wherein the wrapper is hydrophobic.

17. A tobacco smoke filter or filter element according to claim 14, wherein the wrapper is printed or coated on an outer surface thereof, and/or wherein the wrapper is hydrophobic.

18. A smoking article comprising a tip according to claim 1, the tip being joined to a wrapped tobacco rod with one end of the tip towards the tobacco rod.

19. A tobacco smoke filter or filter element according to claim 12, the filter or filter element being joined to a wrapped tobacco rod with one end of the tip towards the tobacco rod.

20. A tip according to claim 1 wherein no smoke can pass through walls of the longitudinally extending element.

* * * * *